US005458186A

United States Patent [19]

Lee et al.

[11] Patent Number: 5,458,186

[45] Date of Patent: Oct. 17, 1995

[54] REFRIGERATOR WITH KIMCHI SEASONING AND STORING CHAMBER

[75] Inventors: Ching H. Lee; Il U. Jeong, both of Busan; Ki C. Woo; Gi Y. Lee, both of Kyungsangnam, all of Rep. of Korea

[73] Assignee: Goldstar Co., Ltd., Seoul, Rep. of Korea

[21] Appl. No.: 104,015

[22] Filed: Aug. 10, 1993

[30] Foreign Application Priority Data

| | | | |
|---|---|---|---|
| Aug. 17, 1992 | [KR] | Rep. of Korea | 14765/1992 |
| Aug. 22, 1992 | [KR] | Rep. of Korea | 15824/1992 |
| Dec. 7, 1992 | [KR] | Rep. of Korea | 23508/1992 |
| Dec. 28, 1992 | [KR] | Rep. of Korea | 25798/1992 |

[51] Int. Cl.[6] ..... F25B 29/00; C12H 1/00; A23B 4/00

[52] U.S. Cl. ..... 165/30; 165/64; 99/470; 99/483; 99/468; 99/486

[58] Field of Search ..... 165/30, 64; 99/470, 99/483, 468, 486

[56] References Cited

U.S. PATENT DOCUMENTS

| | | | |
|---|---|---|---|
| 2,042,384 | 5/1936 | Bird et al. | 165/30 |
| 2,317,816 | 4/1943 | Scott | 165/30 |
| 3,478,818 | 11/1969 | Kohya et al. | 165/30 |
| 3,590,911 | 7/1971 | Horvay | 165/30 |
| 3,638,717 | 2/1972 | Harbour et al. | 165/30 |
| 5,142,969 | 9/1992 | Chun | 99/483 |
| 5,228,499 | 7/1993 | Yoon | 165/30 |
| 5,351,745 | 10/1994 | Park | 165/30 |
| 5,398,599 | 3/1995 | Woo | 165/30 |

*Primary Examiner*—John K. Ford

[57] ABSTRACT

A refrigerator with a kimchi seasoning and storing chamber separately mounted beneath a refrigerating chamber and adapted to season kimchi and maintain the freshness of kimchi and usable for purposes other than the kimchi seasoning and storing purpose. The refrigerator includes an outer case disposed at a lower portion of the refrigerator to define the kimchi seasoning and storing chamber, the outer case having heaters embedded in at least two wall portions thereof, a kimchi container receiving box inserted into the outer case to be opened and closed in a sliding manner and adapted to receive kimchi, an insulating plate mounted on an upper portion of the kimchi container receiving box and adapted to prevent heat in the kimchi container receiving box from being outwardly transferred, the insulating plate having a cold air supply port for introducing a cold air in the kimchi container receiving chamber, duct for guiding the cold air fed by a cooling fan, toward the cold air supply port provided at the insulating plate, a damper for controlling a flow of cold air passing through the duct, and sensors for directly sensing a condition of the kimchi.

13 Claims, 9 Drawing Sheets

REFRIGERATOR WITH KIMCHI SEASONING AND STORING CHAMBER

BACKGROUND OF THE INVENTION

1. Field of the Invention

The present invention relates to a refrigerator, and more particularly to a refrigerator with a kimchi seasoning and storing chamber.

2. Description of the Prior Art

Generally, a refrigerator includes a freezing chamber for storing foods to be stored at a temperature of no more than −10° C. therein and a refrigerating chamber for storing foods to be stored at a temperature of more than −10° C. The refrigerating chamber is disposed beneath the freezing chamber. At the rear wall portion of the freezing chamber, a cooling fan is disposed to supply cold air into the overall interior of the freezing chamber. The refrigerator also includes a duct for introducing the cold air from the cooling fan in the refrigerating chamber and a damper disposed in the duct and adapted to control the opening and closing of the duct.

Referring to FIG. 1 there is illustrated a conventional refrigerator which is equipped with a kimchi chamber, in addition to the general construction as mentioned above. As shown in the drawing, the refrigerator comprises an upper freezing chamber 1*a*, a lower refrigerating chamber 1*b* and a kimchi chamber 1*c* disposed between the freezing chamber 1*a* and the refrigerating chamber 1*b*. At the rear surface of kimchi chamber 1*c*, a cold air inlet 1*e* is disposed, which introduces cold air supplied via a duct (not shown), in the kimchi chamber 1*c*. The kimchi chamber 1*c* is also provided at the bottom portion thereof with a heater 1*g* for generating heat to maintain the internal temperature of the kimchi chamber 1*c* at a temperature of 4° to 10° C., for seasoning the kimchi contained in the kimchi chamber 1*c* and with an insulation 1*b* for preventing heat generated by the heater 1*g* from entering the refrigerating chamber 1*b*.

In the interior of kimchi chamber 1*c*, a kimchi box 1*h* for containing kimchi therein is disposed. The kimchi box 1*h* has at its upper portion a cold air control plate 21*d* for controlling the internal temperature of the kimchi box 1*h* to be a temperature of 4° to 10° C.

As shown in FIG. 2 the cold air control plate 21*d* is slidably mounted by means of a lever 2*a* which is rotatably mounted at its middle portion to a fixed boss 21*b*. At the rear portion of lever 2*a*, a slot 21*e* is formed. At a flange 5*a* of the kimchi box 1*h*, a cold air control member 21*d* of an inverted L-shape is mounted, which is adapted to open and close the cold air inlet 1*e* and thus control the amount of cold air entering the kimchi box 1*h*.

The cold air control member 21*d* is mounted to pivot right and left within the kimchi box 1*h*, by means of a pin received fin the slot 21*e* formed at the rear portion of lever 2*a*.

In the conventional refrigerator with the above-mentioned construction, the kimchi chamber has a temperature zone with a temperature condition different from that of the refrigerating chamber, because it is isolated from both the refrigerating chamber and the freezing chamber. As a result, it is improper to store goods other than kimchi in the kimchi chamber. Furthermore, the kimchi chamber requires a perfect insulation for preventing the low temperature characteristic (no less than −10° C.) of the freezing chamber from affecting the temperature (4° to 10° C.) of kimchi chamber.

This results in an increase in manufacture cost.

For manufacturing such a conventional refrigerator including the kimchi chamber, a separate production line is required because the kimchi chamber constitutes a compartment independent on the refrigerating chamber. Moreover, it is impossible to control the internal temperature and the humidity of the kimchi chamber independently by using the cold air control plate conventionally provided for controlling the internal temperature and humidity of kimchi box.

Since the heater positioned at the bottom the kimchi chamber generate heat only in one direction, kimchi contained in the kimchi chamber is hardly seasoned at the lower portion of the kimchi chamber, even though easily seasoned at the upper portion of the kimchi chamber.

Every time the kimchi box is opened, the stored kimchi comes into contact with air at the exposed surface thereof. Due to such a contact with air, air-favorable fungi living in the kimchi become active, so that the kimchi is acidified early at the exposed surface thereof, as compared with other portions thereof.

SUMMARY OF THE INVENTION

Therefore, an object of the present invention is to provide a refrigerator including a kimchi seasoning and storing chamber which is equipped at its four surfaces with heaters, thereby preventing immature seasoning and overseasoning of kimchi stored in the chamber and uniformly seasoning the kimchi.

Another object of the invention is to provide a refrigerator including a kimchi seasoning and storing chamber which is separably disposed at the lower portion of a refrigerating chamber, without constituting a compartment independent of the refrigerating chamber and is also usable for purposes other than the kimchi seasoning and storing purpose.

Another object of the invention is to provide a refrigerator including a kimchi seasoning and storing chamber which is capable of controlling the internal temperature and the humidity thereof independently by a cold air control assembly for individually controlling the amount of cold air introduced in the kimchi seasoning and storing chamber and the amount of cold air discharged out of the kimchi seasoning and storing chamber.

Another object of the invention is to provide a refrigerator including a kimchi seasoning and storing chamber which is equipped with a sensing unit capable of being disposed in kimchi contained in the kimchi seasoning and storing chamber where the chamber is used for purposes other than the kimchi seasoning and storing purpose, so that the condition of kimchi can be directly detected, thereby enabling a seasoning of kimchi meeting the user's taste.

Another object of the invention is to provide a refrigerator including a kimchi seasoning and storing chamber which has sterilizing means capable of preventing kimchi contained in the chamber from being overseasoned at the exposed surface thereof as the kimchi comes into contact with air when the chamber is opened, so that the uniformly seasoned state of kimchi can be maintained for a long time.

In accordance with the present invention, these objects can be accomplished by providing a refrigerator equipped with an upper freezing chamber and a lower refrigerating chamber comprising: an outer case disposed at a lower portion of the refrigerating chamber to define a kimchi seasoning and storing chamber, the outer case having heaters embedded in at least two wall portions thereof; a kimchi container receiving box inserted into the outer case to be opened and closed in a sliding manner and adapted to receive kimchi; an insulating plate mounted on an upper portion of the kimchi container receiving box arid adapted to prevent heat in the kimchi container receiving box from being outwardly transferred, the insulating plate having a cold air supply port for introducing cold air in the kimchi container receiving chamber; a duct for guiding the cold air fed by a cooling fan, toward the cold air supply port provided at the insulating plate; a damper for controlling the duct to be opened and closed, so as to control a flow of cold air passing through the duct; and sensing means for directly sensing a condition of the kimchi.

As the heaters embedded in at least two wall portions of the outer case defining the kimchi seasoning and storing chamber generate heat, kimchi contained in the kimchi seasoning and storing chamber is seasoned. The sensors embedded in the kimchi sense the temperature, the salinity, the pH of the kimchi and thus directly sense the condition of the kimchi. Depending on the detected kimchi condition, cold air passing through the duct is introduced in the kimchi container receiving box, so that the seasoned kimchi is kept at an optimum storing condition.

The kimchi seasoning and storing chamber is separably disposed beneath the refrigerating chamber of a refrigerator and is usable for storing other foods. The heaters which are provided in at least two side wall portions and the lower portion of the kimchi seasoning and storing chamber serve to uniformly season the kimchi.

Since an ultraviolet ray lamp is disposed at the middle portion of the interior of a lid of the kimchi container, air-favorable fungi actively living at the surface of kimchi are sterilized each time the kimchi container is opened and closed. Accordingly, it is possible to prevent the kimchi from being acidified early at the exposed surface thereof.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
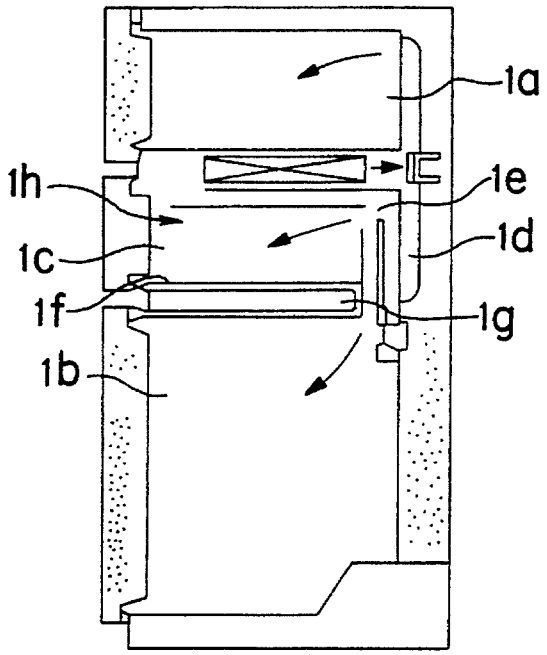
FIG. 1 PRIOR ART
FIG. 1 is a sectional view of a conventional refrigerator with a kimchi chamber.
Figure 2:
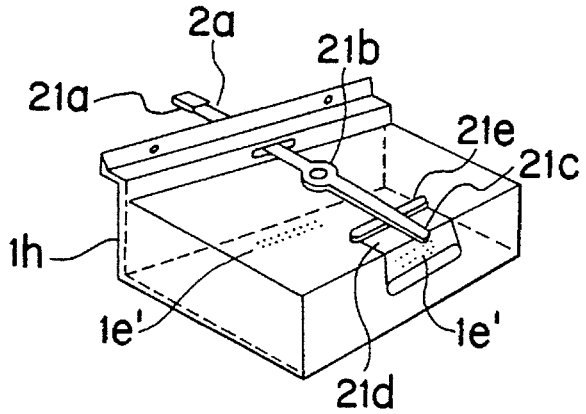
FIG. 2 PRIOR ART
FIG. 2 is a perspective view of a cold air control plate provided at a kimchi receiving box in the conventional refrigerator.
Figure 3:
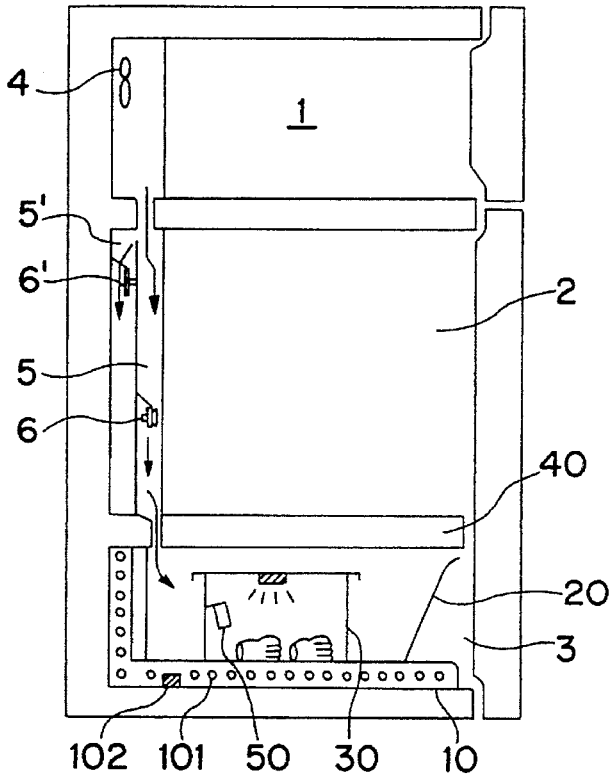
FIG. 3 is a sectional view of a refrigerator with a kimchi seasoning and storing chamber according to the present invention.

FIG. 3 is a sectional view of a refrigerator with a kimchi seasoning and storing chamber in accordance with the present invention. As shown in FIG. 3, the refrigerator comprises a body including an upper freezing chamber 1, an intermediate refrigerating chamber 2 and a lower kimchi seasoning and storing chamber 3.

Where the refrigerator is equipped with a vegetable chamber (not shown) the kimchi seasoning and storing chamber 3 is disposed to the left or to the right of the vegetable chamber. Where the refrigerator is not equipped with a vegetable chamber, the kimchi seasoning and storing chamber 3 is disposed at the lower portion of the interior of refrigerating chamber 2.

The kimchi seasoning and storing chamber 3 includes an outer case 10 fixedly mounted at the lower portion of refrigerating chamber 2, a kimchi container receiving box 20 disposed in the outer case 10 and adapted to receive a kimchi container 30, and an insulation plate 40 disposed at the top portion of outer case 10.

At the rear portion of the freezing chamber 1, a cooling fan 4 is disposed to supply cold air generated from a cold air source into the overall interior of freezing chamber 1. At the rear portion of the refrigerator, a pair of ducts 5 and 5' are provided, which are adapted to guide the cold air supplied from the cooling fan 4 toward the refrigerating chamber 2 and the interior of the kimchi container receiving box 20, respectively. In the ducts 5 and 5', a pair of dampers 6 and 6' are disposed for controlling the ducts 5 and 5' to be opened and closed.

The ducts 5 and 5' are constructed to form a single duct. In similar, the dampers 6 and 6' are constructed to form a single damper. In the following description, accordingly, the ducts 5 and 5' and the dampers 6 and 6' will be described by use of the single duct and the single damper which are denoted by the reference numerals 5 and 6, respectively, for a simplicity of the description.

Heaters 101 are embedded in the left and right side portions, the rear portion and the lower portion of the outer case 10, respectively. The heaters 101 may be disposed on only two or more portions of the outer case 10.

In the lower portion of outer case 10, a sensor 102 is embedded, which is adapted to sense temperature of the heaters 101 and thus prevent the overheating of the heaters 101.

The kimchi container receiving box 20 is constructed to be slidably inserted and retracted in the outer case 10, as a conventional vegetable box. With the construction of the kimchi container receiving box 20, the kimchi container 30 can be easily received in and removed from the kimchi container receiving box 20. It is also possible to separate the kimchi container receiving box 20 from the outer case 10, if necessary.

Figure 8:
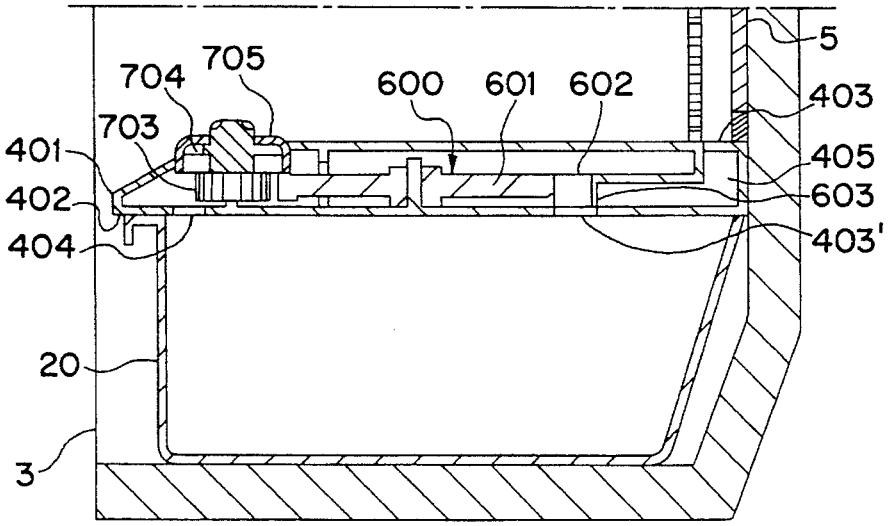
FIG. 8 is a sectional view of a cold air control assembly mounted to an insulating plate and adapted to be used for storing foods other than kimchi, in the refrigerator with the kimchi seasoning and storing chamber according to the present invention.

The insulating plate 40 comprises an upper plate portion 401 and a lower plate portion 402 as shown in FIG 8. Preferably, an air layer for insulation is formed between the upper plate portion 401 and the lower plate portion 402.

Between the upper plate portion 401 and the lower plate portion 402, the insulating plate 40 has at its rear portion a cold air supply port 403 for introducing the cold air passing through the duct 5 in the kimchi container receiving box 20. The cold air introduced in the kimchi container receiving box 20 is exhausted through a gap defined between the top of the kimchi container receiving box 20 and the bottom of the insulating plate 40.

Where the kimchi container receiving box 20 is used as a vegetable chamber or a chamber for other foods, it is provided with a cold air control assembly 60 for controlling both the internal temperature and the humidity of the kimchi container receiving box 20, so as to maintain the freshness of vegetables and foods stored in the kimchi container receiving box 20.

Figure 4:
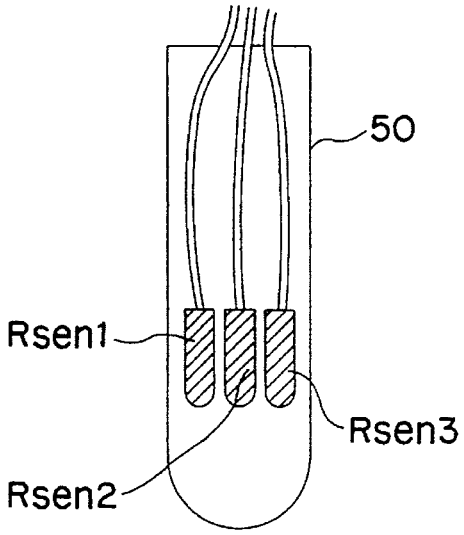
FIG. 4 is a sectional view of a sensing unit provided at a kimchi container according to the present invention.

FIG. 4 is a sectional view of a sensing unit 50 which detects the temperature, the salinity, and the pH of kimchi stored in the kimchi seasoning and storing chamber and thus directly senses the condition of the kimchi, in accordance with the present invention. The sensing unit 50 includes sensors $R_{SEN1}$ to $R_{SEN3}$ for detecting the temperature, the salinity and the pH of kimchi, respectively, so as to monitor the kimchi seasoning condition and the seasoned state of the kimchi.

Figure 5:
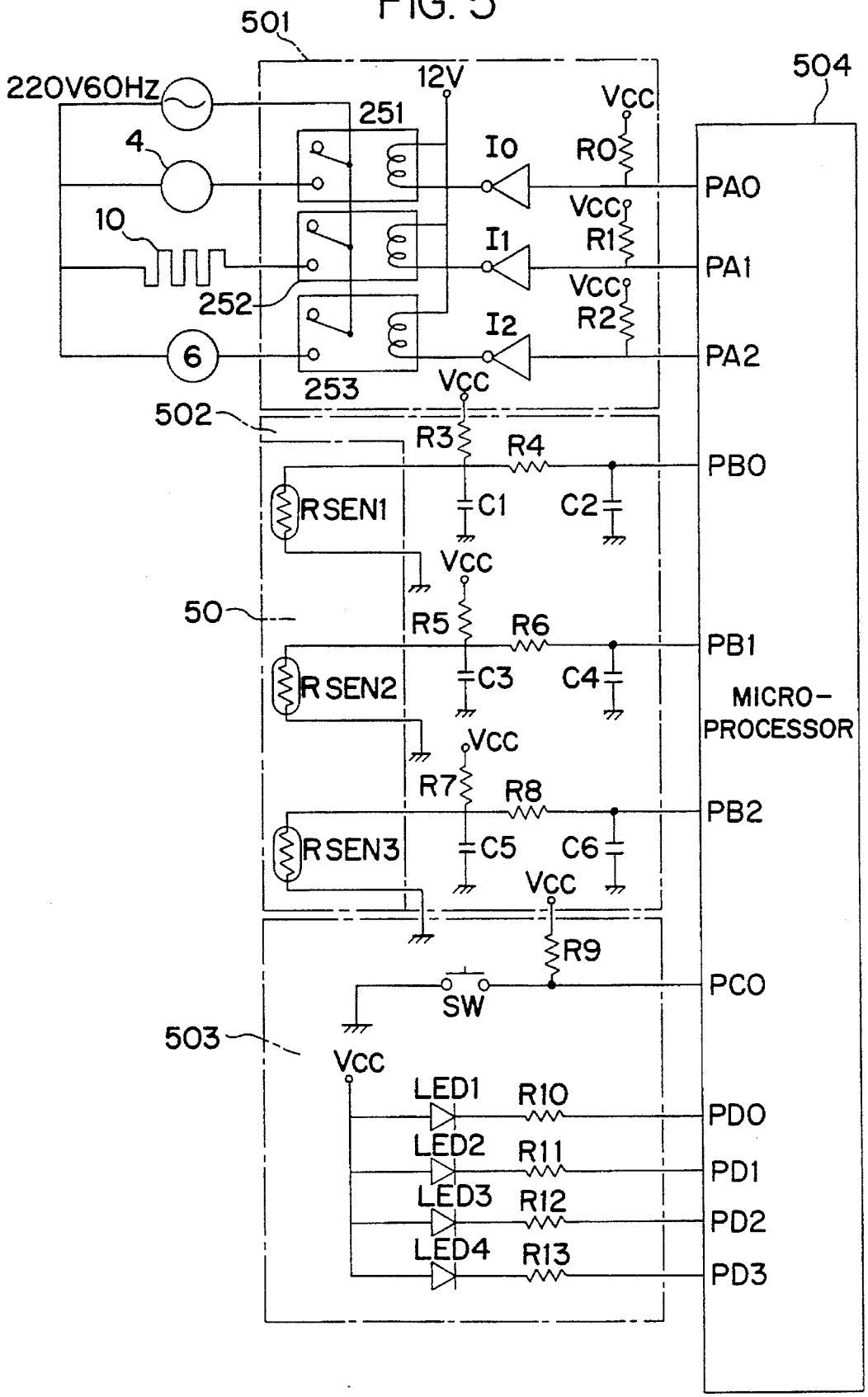
FIG. 5 is a circuit diagram of a control circuit for controlling an operation of the refrigerator with the kimchi seasoning and storing chamber according to the present invention.

Referring to FIG. 5, there is illustrated a control circuit of the refrigerator according to a first embodiment of the present invention. The control circuit which is the sensing unit 50 comprises a kimchi seasoning control circuit 501 constituted by a cooling fan driving relay 251, a heater driving relay 252 a damper driving relay 253, inverters $I_0$ to $I_2$ and resists $R_0$ to $R_2$. The kimchi seasoning control circuit 501 serves to control the operation of the damper 6 associated with the kimchi seasoning and storing chamber 3. The sensing unit 50 also comprises a kimchi condition sensing circuit 502 constituted by a sensor $R_{SEN1}$ for sensing the internal temperature, $R_{SEN2}$ for sensing the salinity, $R_{SEN3}$ for sensing the pH, resists $R_3$ to $R_8$ and condensers $C_1$ to $C_6$. The kimchi condition sensing circuit 502 is directly dipped in the kimchi contained in the kimchi container 30 and serves to directly sense the temperature, the salinity and the pH of the kimchi. The sensing unit. 50 also comprises a display, circuit 503 constituted by a kimchi notch select switch SW, light emitting diodes $LED_1$ to $LED_4$, and resists $R_{10}$ to $R_{13}$. The display circuit 503 serves to display a kimchi seasoning condition selected as one of "HIGH", "NORMAL" and "LOW" according to the user's notch selection and a storing mode. A microprocessor 504 is also provided, which is adapted to derive the kimchi seasoning condition, based on the internal temperature, the salinity and the pH of the kimchi, and a notch condition selected by the user, all of which are sensed by the kimchi condition sensing circuit 502. The microprocessor 504 controls the driving of heaters 101, based on the derived kimchi seasoning condition and thus controls the seasoning of kimchi.

Figure 6:
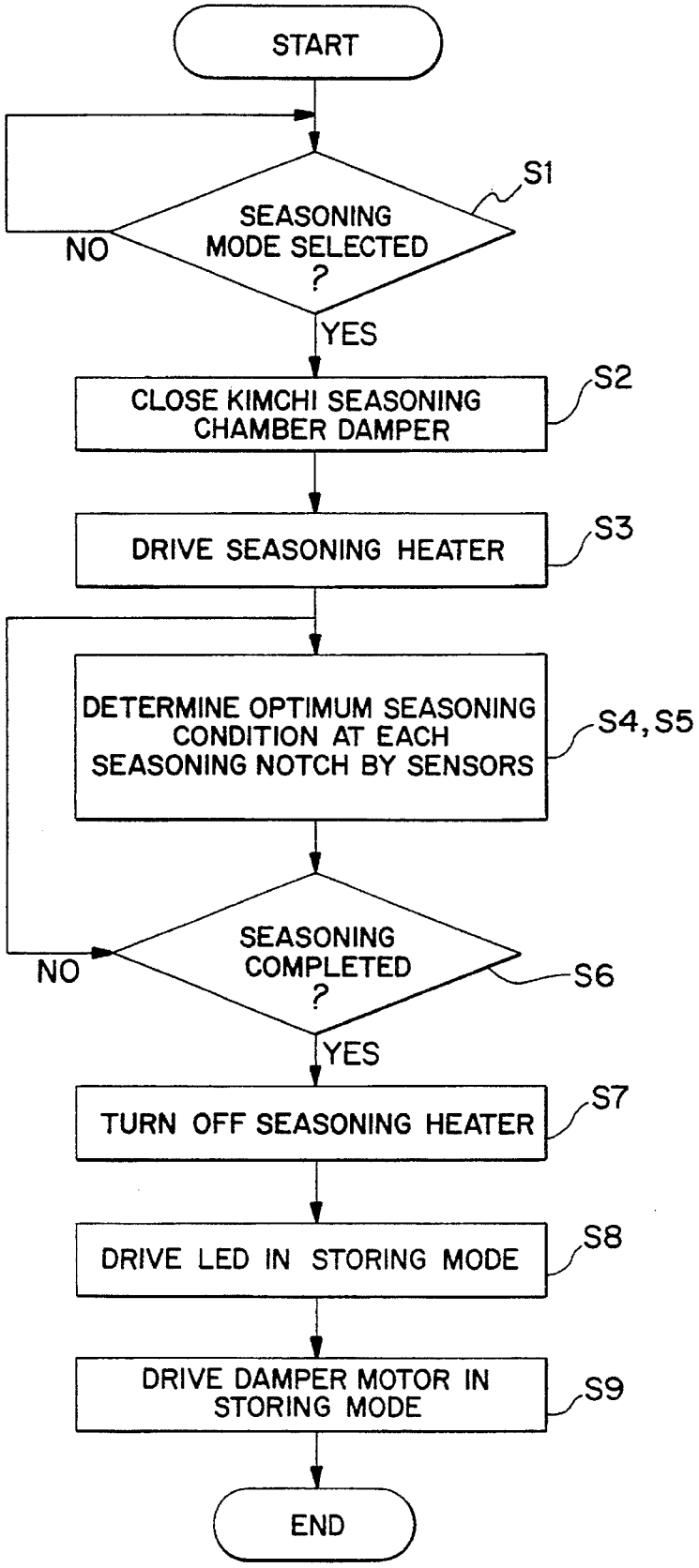
FIG. 6 is a flow chart, illustrating a method of controlling the kimchi seasoning according to the present invention.

FIG. 6 is a flow chart illustrating a method of controlling the kimchi seasoning in the refrigerator with the kimchi seasoning and storing chamber according to the present invention.

As shown in FIG. 6, the method comprises a first procedure including three steps S1 to S3 of checking whether a notch condition indicative of a desired kimchi seasoning degree has been selected by a selection of the kimchi notch select switch SW and driving the heaters 101 at the closed state of the damper 6 disposed at the rear portion of kimchi seasoning and storing chamber 3, when the notch condition has been selected. Following the first procedure, a second procedure is executed, which includes two steps S4 and S5 of deriving a kimchi seasoning condition, based the desired seasoning degree selected by the user, seasoning the kimchi according to the derived kimchi seasoning condition, and determining whether the current seasoned degree of the kimchi is the optimum degree as desired. The method also comprises a third procedure including four steps S6 to S9 of checking whether the seasoning of kimchi has been completed, turning off the heaters 101 when the seasoning of kimchi has been completed, turning on the light emitting diode $LED_4$ of the display circuit 503, and controlling the operation of damper 6.

Figure 7:
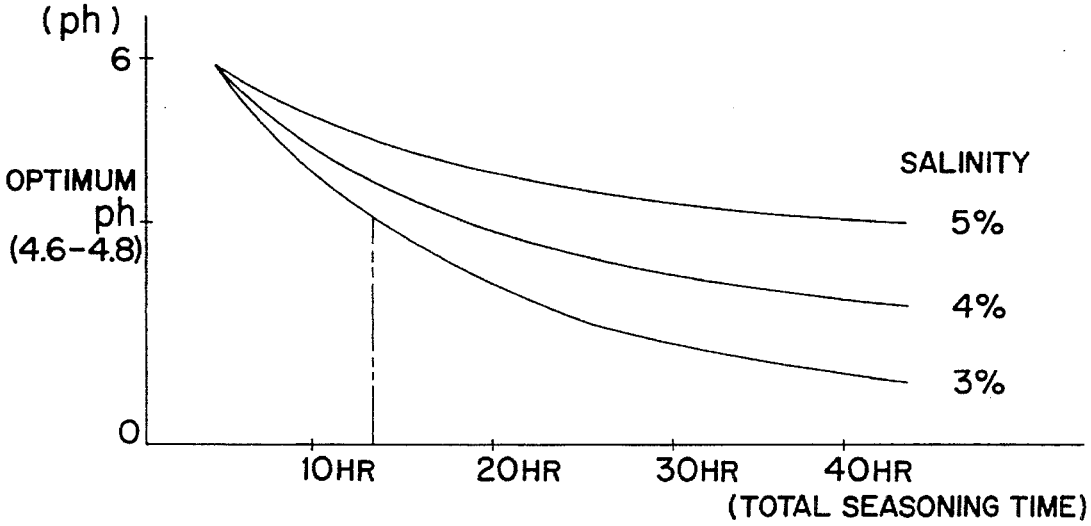
FIG. 7 is a graph illustrating variations in salinity and pH depending on the seasoned time of kimchi, in accordance with the method of the present invention.

FIG. 7 is a graph illustrating variations in salinity and pH depending on the seasoned time of kimchi in the refrigerator with the kimchi seasoning and storing chamber according to the present invention. As shown in FIG. 7, the higher the salinity of kimchi, the lower the pH.

Figure 9:
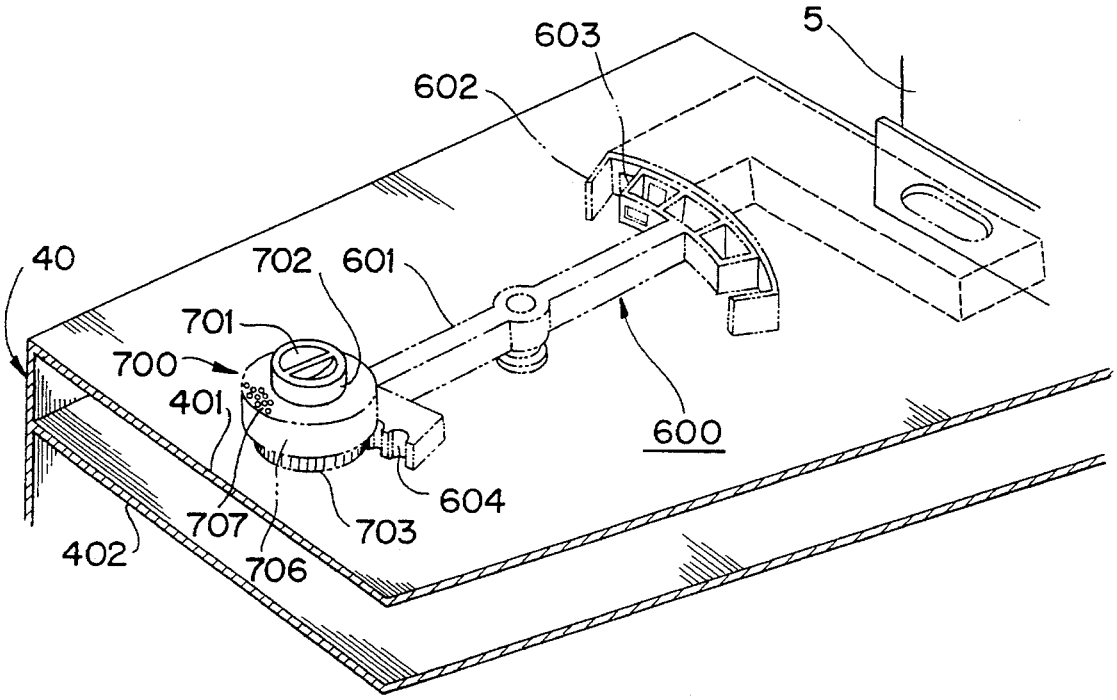
FIG. 9 is a perspective view illustrating a condition that the cold air control assembly is mounted in the kimchi container receiving box, in accordance with the present invention.

Referring to FIGS. 8 and 9, there is illustrated the insulating plate 40 employed in a case where the kimchi container receiving box 20 is used for storing vegetables or other foods. As shown in FIGS. 8 and 9, the insulating plate 40 is of a hollow structure including a pair of spaced plate portions 401, 402 and has at its rear portion cold air supply ports 403 and 403' which are formed at the upper plate portion 401 and the lower plate portion 402, respectively, for introducing the cold air passing through the duct 5 in the kimchi container receiving box 20. At the front portion of insulating plate 40, a cold air exhaust port 404 is formed for outwardly exhausting the cold air out of the kimchi seasoning and storing chamber 3.

Defined between the upper and lower plate portions 401 and 402 of the insulating plate 40 is a guide passage 405 adapted to guide the cold air introduced through the cold air supply port 403 toward the cold air supply port 403'.

A cold air control assembly is disposed in the guide passage 405 between the cold air supply ports 403 and 403'. The cold air control assembly comprises a valve member 600 and a control member 700.

The valve member 600 is pivotally mounted in the insulating plate 40 at the rear portion of guide passage 405 and adapted to control the amount of cold air introduced to the guide passage 405 and supplied in the kimchi seasoning and storing chamber 3 through cold air supply port 403'. The control member 700 is disposed at the front portion of insulating plate 40, to control the amount of cold air exhausted from the kimchi container receiving box 20.

The control member 700 is rotatably mounted at the front portion of insulating plate 40 'such that its upper portion is upwardly protruding from the insulating plate 40 and adapted to pivot, the valve member 600 by its rotation and thus control the amount of cold air exhausted via the cold air exhaust port 404.

Figure 10:
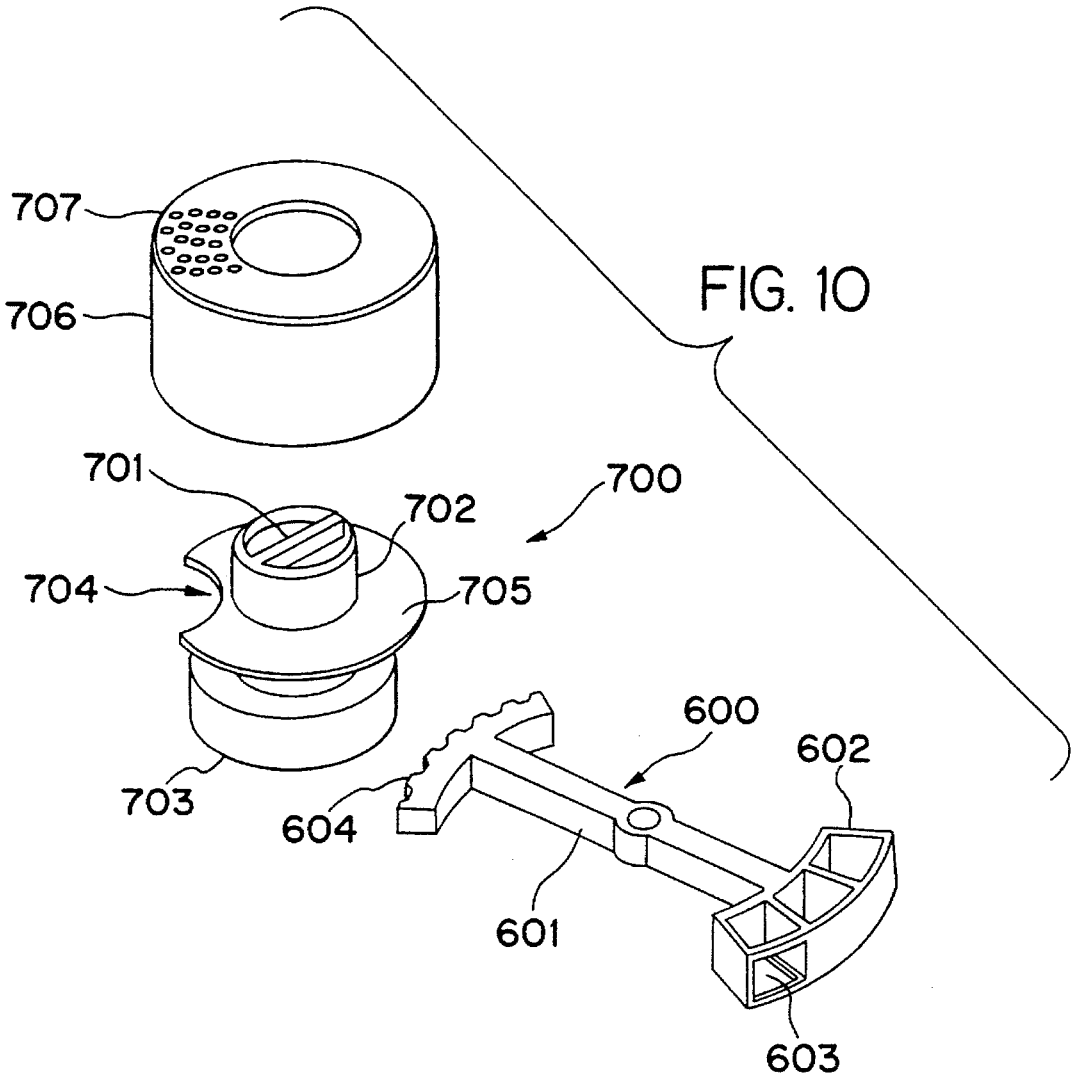
FIG. 10 is an exploded perspective view of the cold air control assembly.

FIG. 10 is a perspective view of the valve member 600 and the control member 700 of the cold air control assembly 60 shown in FIG. 8, As shown in FIG. 10, the valve member 600 has a lever port ion 601 pivotally mounted to the lower plate portion 402 of insulating plate 40, a valve plate portion 602 formed at one end of the lever portion 601 and adapted to open and close the guide passage 405 according to the pivotal movement of the lever portion 601, a guide port 603 formed at one side portion of the valve plate portion 602 and adapted to guide a flow of cold air to the interior of kimchi container receiving box 2 when it communicates with the guide passage 405, a rack 604 formed at the other end of lever portion 601 and adapted to receive the rotation force of the control member 700 and rotate the lever portion 601 in a normal direction and a reverse direction.

The guide port 603 is arranged to be aligned with the cold air supply port 403' formed at the lower plate portion 402 of insulating plate 40.

The control member 700 has a knob 702 rotatable mounted to the lower plate portion 402 of insulating plate 40 and provided at its upper surface with a grip portion 701 integrally formed therewith, a pinion 703 formed at the lower portion of knob 702 and adapted to engage with the rack 604 formed at the valve member 600, a wing 705 formed at the upper portion of knob 702 and provided at one side portion thereof with a groove 704, and a knob cover 706 supported on the upper surface of wing 705 such that it can slide rotatably irrespective of the rotation of the knob 702.

A plurality of holes 707 are formed at the knob cover 706. The holes 707 are selectively overlapped with the groove 704 of the wing 705, so as to control the amount of cold air exhausted out of the kimchi seasoning and storing chamber 3 toward the refrigerating chamber 2.

As the grip portion 701 is rotated, the groove 704 of wing 705, the cold air exhaust port 404 formed at the front portion of insulating plate 40 and the holes 707 become aligned with one another.

Figure 11:
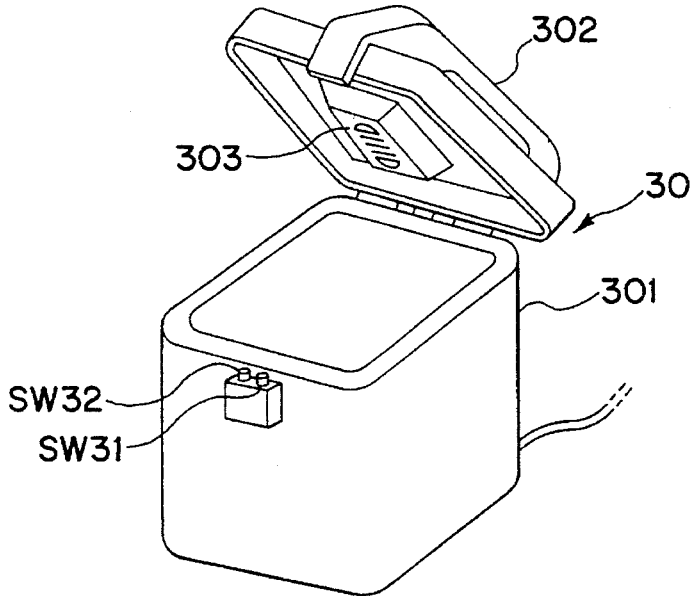
FIG. 11 is a perspective view of the kimchi container according to the present invention.

FIG. 11 is a perspective view illustrating the kimchi container 30 received in the kimchi container receiving box 20 of the kimchi seasoning and storing chamber 3. The kimchi container 30 includes a container body 301 having an opened upper end and provided at one side portion thereof with a pair of push switches $SW_{31}$ and $SW_{32}$ disposed adjacent to the opened upper end, a lid 302 pivotally mounted to the opened upper end of container body 301 by means of a hinge member disposed at the other side portion of container body 301, an ultraviolet ray lamp 303 mounted at the inner central portion of the lid 302, and a drive circuit 304 adapted to turn on the ultraviolet ray lamp 303 according to a switching operation of the push switch $SW_{31}$.

Figure 12:
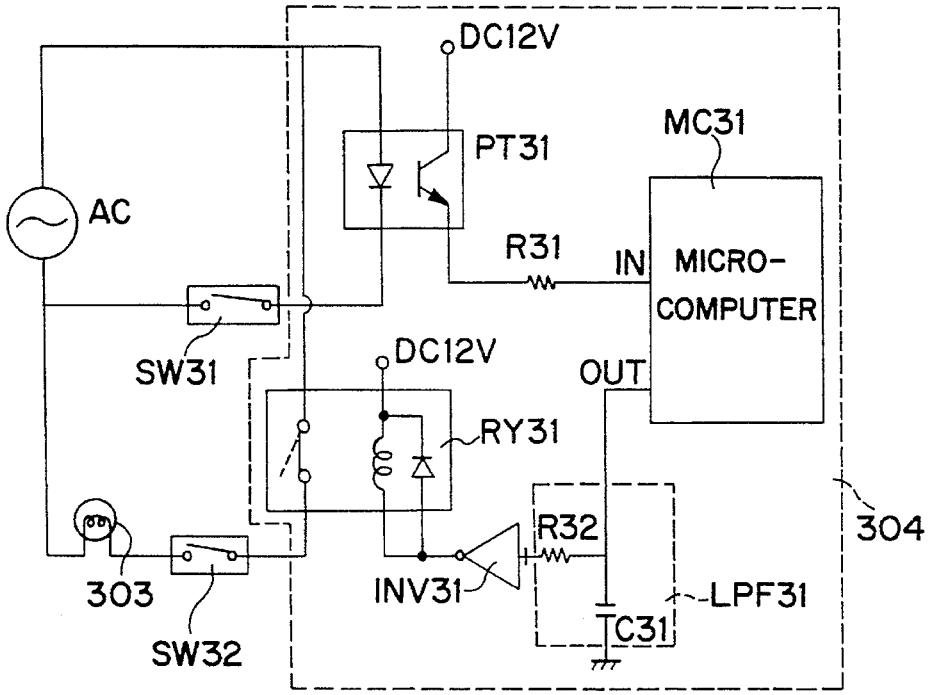
FIG. 12 is a circuit diagram of a drive circuit for the kimchi container according to the present invention.

FIG. 12 is a circuit diagram illustrating the drive circuit 304 of FIG. 11. As shown in FIG. 12, the drive circuit 304 comprises a photo transistor $PT_{31}$ adapted to be switched according to the switching ON/OFF of the push switch $SW_{31}$ (that is, the push switch $SW_{31}$ is turned off at an opened state of the lid 302 and turned on at a closed state of the lid 302), so as to supply AC power from an AC power source connected to the push switch $SW_{31}$. The drive circuit 304 also comprises a microcomputer $M_{31}$ connected to the photo transistor $PT_{31}$ and adapted to receive a signal generated from the photo transistor $PT_{31}$. At the output of the microcomputer $MC_{31}$, a, low pass filter $LPF_{31}$ is provided which as constituted by a resist $R_{32}$ and a condenser $C_{31}$ and adapted to detect a control signal by the resist $R_{32}$ and the condenser $C_{31}$. Connected in series to the low pass filter $LPF_{31}$ are an inverter $INV_{31}$ for inverting the control signal detected by the low pass filter $LPF_{31}$, a relay $RY_{31}$ for turning on the ultraviolet ray lamp 303, and a push switch $SW_{32}$ connected between the output of relay $RY_{31}$ and the ultraviolet ray lamp 303, for preventing a malfunction.

In the above-mentioned construction, when the lid 302 is opened, the ultraviolet ray lamp 303 is always turned off. On the other hand, when the lid 302 is closed, the ultraviolet ray lamp 303 is turned on for a predetermined time and then turned off.

Figure 13:
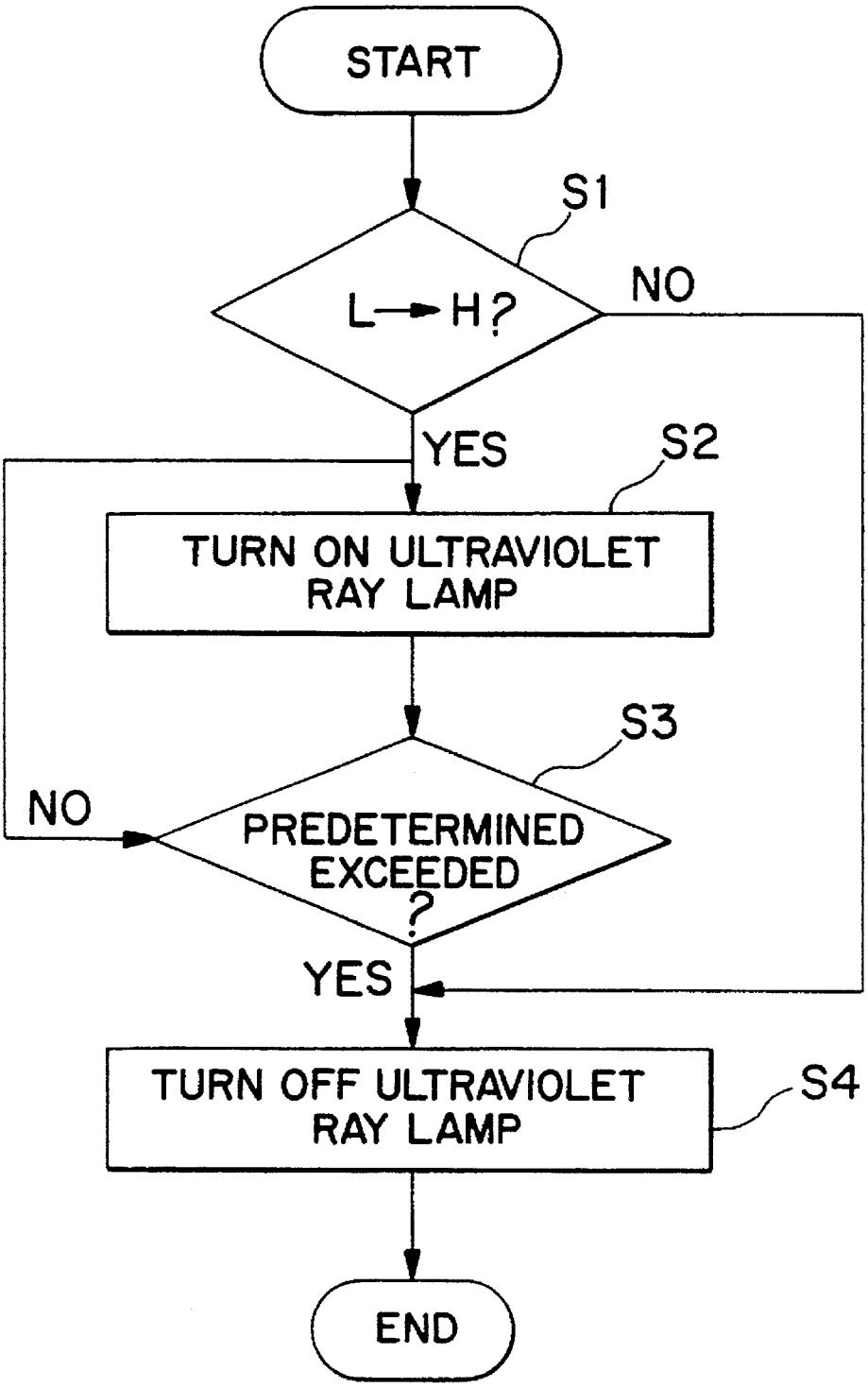
FIG. 13 is a flow chart illustrating an operation for controlling the drive circuit of FIG. 11, in accordance with the present invention.

Referring to FIG. 13, there is illustrated a flow chart illustrating a method for controlling the kimchi container 30. In accordance with the method, the ultraviolet ray lamp 303 is turned on for a predetermined time and then turned off, based on a control signal outputted from the microcomputer $MC_{31}$.

As electric power is applied to the refrigerator with the kimchi seasoning and storing chamber according to the present invention, cold air is generated from the cold air source and then fed to the duct 5' by the cooling fan 4 disposed at the rear wall portion of the freezing chamber 1. As the duct 5' is opened by driving the damper 6' disposed in the duct 5', the cold air is introduced in the refrigerating chamber 2 via the duct 5'.

In using the kimchi seasoning and storing chamber of the above-mentioned construction, kimchi not yet seasoned is first contained in the kimchi container 30 which is, in turn, received in the kimchi seasoning and storing chamber 3. Thereafter, the notch select switch SW is switched on, so that the heaters 101 are supplied with electric power and thus generate heat. As the kimchi container 30 is heated by the heat generated from the heaters 101, kimchi contained in the kimchi container 30 becomes seasoned.

As mentioned above, the heaters 101 are provided at the left and right portions, the rear portion, and the bottom portion of outer case 10. Accordingly, the kimchi contained in the kimchi container 30 becomes uniformly seasoned.

When the heaters 101 generate heat, the kimchi condition sensing unit 50 detects the temperature, the salinity and, the pH of kimchi contained in the kimchi container 30. Simultaneously, the damper 6 disposed in the duct 5 operates to close the cold air passage. As a result, the introduction of the cold air in the kimchi seasoning and storing chamber 3 via the cold air supply ports 403 and 403' formed at the upper and lower plate portions 401 and 402 of insulating plate 40 is shut off. Thus, the seasoning of kimchi is initiated.

When the sensing unit 50 detects a signal indicative of the completion of the seasoning of kimchi, the heaters 101 are turned off and the damper 6 operates to open the cold air passage of the duct 5. Accordingly, the cold air passing through the duct 5 is introduced in the kimchi seasoning and storing chamber 3 via the cold air supply ports 403 and 403' of insulating plate 40. Thus, the storing of kimchi is initiated.

After the kimchi condition sensing unit 50 with the construction of FIG. 3 is dipped in the kimchi contained in the kimchi container 30, the kimchi notch select switch SW is switched on. At the ON state of the kimchi notch select switch SW, the microprocessor 504 of FIG. 5 scans a low level signal inputted at its port PC0 and thus recognizes the notch condition currently selected by the user, which notch condition is one of "HIGH", "NORMAL" and "LOW" conditions.

When the microprocessor 504 receives the low level signal at its port PC0, it outputs a high level signal through its port PA2. By the high level signal from the microprocessor 504, the damper driving relay 253 is activated to close the damper 6.

Thereafter, the microprocessor 504 outputs a high level signal through its port PA1, so that the heater driving relay 252 is activated, thereby causing the heaters 101 to generate heat.

When the internal temperature of kimchi in the kimchi container 30 reaches a predetermined temperature by the heat from the heaters 101, the sensor $R_{SEN1}$ generates a detect signal indicative of the reaching of the predetermined temperature. The detect signal from the sensor $R_{SEN1}$ is received in the microprocessor 504 through the port PB0, so that the microprocessor 504 outputs a low level signal through its port, PA1. By the low level signal from the microprocessor 504, the heater driving relay 252 and thus the heaters 101 are turned off. Thus, the heating operation is shut off.

When the internal temperature of kimchi is lowered to the predetermined temperature after shutting off the heating, a high level signal is outputted again from the port PA1 of microprocessor 504, to generate heat from the heater 101 again.

As apparent from the above description, after the internal temperature of kimchi in the kimchi container 30 reaches the predetermined temperature, the turning on and off of the heaters 101 are repeatedly carried out so that the internal temperature of kimchi container 30 is always uniformly maintained, in order to avoid a phenomenon that kimchi becomes overseasoned.

In addition to the signal from the temperature sensor $R_{SEN1}$, the seasoning of kimchi is also controlled by signals generated from the salinity sensor $R_{SEN2}$ and pH sensor $R_{SEN3}$.

That is, the longer driving time of heaters 101 is required at the higher salinity, because the rate of kimchi being seasoned becomes lower at the same condition. For example, the time taken in seasoning kimchi is one day at the salt content of 3%, but two or three days at the salt content of 5%.

By the pH sensor $R_{SEN3}$, the finally seasoned state of kimchi is sensed. At the lower pH, the acidity becomes higher. The pH for the optimum seasoned state is about 4.6 to about 4.8.

Now, the procedures will be described, in conjunction with a case where the user sets the notch condition to "NORMAL" state.

When the user selects "NORMAL" notch condition by manipulating the notch select switch SW, a corresponding signal is inputted at the microprocessor 504 via the port PC0. According to the received signal, the microprocessor 504 outputs a low level signal through its port PD2. By the low level signal, the light emitting diode $LED_2$ of the display circuit 603 emits light, thereby informing the user of the selected notch condition.

Also, the microprocessor 504 outputs a high level signal through its port PA1. By the high level signal, the heaters 101 are turned on, so that the kimchi becomes seasoned.

The heat generation from the heaters 101 is continued until the sensors $R_{SEN1}$ to $R_{SEN3}$ of sensing unit 50 sense the completion of the seasoning of kimchi. Also, the damper 6 is driven so that the duct 5 is maintained at its closed state, as the microprocessor 504 outputs a high level signal through its port PA2 so that the damper driving relay 253 is switched on, to close the damper 6.

When sensors $R_{SEN1}$ and $R_{SEN3}$ of the sensing unit 50 outputs signals indicative of the completion of the seasoning of kimchi at the microprocessor 504, the microprocessor 504 outputs a high level signal and a low level signal through ports PA1 and PA2, respectively. By the signals, the cooling fan driving relay 251 and the damper driving relay 253 are switched on and off, respectively, so that cold air from the cooling fan 4 is fed to the kimchi container receiving box 20 via the duct 6.

By the cold air supplied in the interior of kimchi container receiving box 20, the temperature of kimchi becomes lowered.

On the other hand, a low level signal from the port PD0 of the microprocessor 504 is applied to the light emitting diode LED for displaying the kimchi storing mode so that the user recognizes the same mode.

Where the kimchi container receiving box 20 is used for storing vegetables or foods other than kimchi, its humidity and internal temperature are controlled for maintaining the freshness of the stored vegetables or foods for a long time Now, the operation of the cold air control assembly for controlling the humidity and internal temperature of the kimchi container receiving box 20 by the cold air supplied through the duct 5 will be described, in conjunction with FIGS. 8 to 10.

The cold air generated at the freezing chamber 1 is fed through the duct 5 by the cooling fan 4 and then introduced in the kimchi container receiving box 20 through the cold air supply ports 403 and 403' formed at the upper and lower plate portions 40]and 402 of the insulating plate 40. The introduced cold air circulates through the interior of kimchi container receiving box 20 and is then exhausted through the cold air exhaust port 404.

At this time, when the user desires to control the amount of cold air supplied to the kimchi container receiving box 20 and the amount of cold air exhausted out of the kimchi container receiving box 20, he manipulates the control member 700 shown in FIGS. 8 to 10.

As the user grips the grip portion 701 formed at the upper surface of the knob 702 of control member 700 by his fingers and rotates it clockwise, the pinion 703 formed at the lower portion of knob 702 rotates by the rotation force of knob 702. By the rotation of pinion 703, the rack 604 formed at the other end of lever portion 601 constituting the valve member 600 and engaged with the pinion 703 rotates counterclockwise about the pivot of the lever portion 601. By the rotation of the rack 604 and thus the lever portion 601, the guide port 603 of the valve plate portion 602 formed at one end of lever portion 601 is vertically aligned and thus communicated with the guide passage 405 formed between the upper and lower plate portions 401 and 402 of insulating plate 40.

Accordingly, the cold air passing through the duct 5 can be fed to the kimchi container receiving box 20 while being continuously guided along the guide passage 405 and the guide to port 603.

On the other hand, when the knob 702 rotates counterclockwise, the lever portion 601 rotates clockwise, so that the valve plate portion 602 formed at one end of lever portion 601 closes the guide passage 405, so that the cold air passing through the duct 5 can not enter the kimchi container receiving box 20.

The cold air introduced in the kimchi container receiving box 20 of the kimchi seasoning and storing chamber 3 is exhausted through the cold air exhaust port 404. The exhaust of cold air is achieved when the groove 704 formed at the wing 705 is aligned with the holes 707 formed at the knob cover 706 by a manipulation of the grip portion 701. That is, the exhaust of cold air is carried out through the cold air exhaust port 404 and the holes 707.

As apparent from the above description, both the internal temperature and the humidity of the kimchi container receiving box 20 are simultaneously controlled by the cold air control assembly. When the guide passage 405 of insulating plate 40 is maintained at its opened state while the cold air exhaust port 404 is closed, the internal temperature of the kimchi container receiving box 20 becomes lowered, whereas the humidity is maintained at the current state. On the other hand, when both the guide passage 405 and the cold air exhaust port 404 are opened, both the internal temperature and the humidity are lowered.

When the guide passage 405 is maintained at its closed state while the cold air exhaust port 404 is opened, the internal temperature of the kimchi container receiving box 20 becomes increased, whereas the humidity is slowly lowered. On the other hand, when both the guide passage 405 and the cold air exhaust port 404 are closed, the internal temperature is increased, whereas the humidity is maintained at the current state.

As apparent from the above description, the internal temperature and humidity of the kimchi seasoning and storing chamber can be simultaneously controlled according to the user's selection.

As the user opens and closes the kimchi container 30, for taking the kimchi contained in the kimchi container 30, an over-seasoning may occur at the surface of kimchi. Now, an operation for preventing such an over-seasoning according to the present invention will be described, in conjunction with FIGS. 11 to 13.

When the lid 301 of kimchi container 30 is positioned at its closed position, the push switch $SW_{31}$ disposed at the kimchi container 30 is switched to its ON state. At the ON state of push switch $SW_{31}$, the photo transistor $PT_{31}$ is switched to its ON state, so that a high level signal is fed to the microcomputer $MC_{31}$ of FIG. 12.

On the other hand, when the lid 30t of kimchi container 30 is positioned at its opened position, a low lever signal is Fed to the microcomputer $MC_{31}$. Based on the low level signal, the microcomputer $MC_{31}$ outputs a signal for activating the relay $RY_{31}$. By the output signal, the relay $RY_{31}$ is activated, thereby causing the ultraviolet ray lamp 303 of FIGS. 11 and 12 to be turned on for a predetermined and then turned off.

That is, the ultraviolet ray lamp 303 is turned on for a predetermined time and the turned off, for sterilizing air-favorable fungi which become active when the kimchi container 30 is opened and closed.

The ultraviolet ray lamp 303 is turned on for a time capable of sterilizing only fungi more activated.

The push switch $SW_{32}$ for preventing a malfunction serves as a safety device. When the push switch $SW_{32}$ is switched off, the microcomputer $MC_{31}$ recognizes that the lid 302 is at its opened state and thus turns off the ultraviolet ray lamp 303.

The above procedure will be described in detail, in conjunction with FIG. 13.

The signal inputted at the microcomputer $MC_{31}$, which is at a low level upon opening the lid 302, is inverted to a high level when the lid 302 is closed. When the signal is inverted from the low level to the high level, the relay $RY_{31}$ is activated, thereby causing the ultraviolet ray lamp 303 to be turned on. At this time, a time for sterilizing air-favorable fungi more actively living at the surface of kimchi is counted.

When the time for sterilizing air-favorable fungi has elapsed, the relay $RY_{31}$ is switched off, thereby causing the ultraviolet ray lamp 303 to be turned off.

That is, the air-favorable fungi are sterilized every time the lid 302 is opened and closed. Accordingly, it is possible to prevent the kimchi from being acidified early at the exposed surface thereof, as compared with other portions thereof.

As apparent from the above description, the present invention provides a refrigerator including a kimchi seasoning and storing chamber separably disposed beneath the lower portion of its refrigerating chamber most remote from its freezing chamber which is a cold air source and heaters uniformly arranged at all portions of an outer case defining the kimchi seasoning and storing chamber therein. With such a construction, the refrigerator is simple in construction and capable of achieving the uniform seasoning of kimchi.

In accordance with the present invention, the point of time For completing the seasoning of kimchi is determined by the internal temperature of the kimchi container, and the salinity, the pH and the acidity of kimchi sensed by various sensors of a sensing unit embedded in the kimchi. As a result, the kimchi can be accurately seasoned to a seasoning degree as desired by the user. In accordance with the present invention, both the internal temperature and the humidity of the kimchi seasoning and storing chamber are simultaneously controlled according to the user's selection. Also, air-favorable fungi are sterilized every time the kimchi container is opened and closed. Accordingly, it is possible to prevent, the kimchi. From being acidified early at the exposed surface thereof and thus maintain the freshness of kimchi for a long time.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator equipped with an upper freezing chamber and a lower refrigerating chamber comprising:

an outer case disposed at a lower portion of the refrigerating chamber to define a kimchi seasoning and storing chamber, the outer case having heaters embedded in at least two wall portions thereof;

a kimchi container receiving box inserted into the outer case to be opened and closed in a sliding manner and adapted to receive kimchi;

an insulating plate mounted on an upper portion of the kimchi container receiving box and adapted to prevent heat in the kimchi container receiving box from being outwardly transferred, the insulating plate having a cold air supply port for introducing cold air into the kimchi container receiving box;

a duct for guiding the cold air fed by a cooking fan, toward the cold air supply port provided in the insulating plate;

a damper for controlling the duct to be opened and closed, so as to control a flow of cold air passing through the duct; and sensing means for directly sensing a condition of the kimchi.

2. The refrigerator in accordance with claim 1, wherein the insulating plate is of a hollow structure having an air layer for insulation.

3. The refrigerator in accordance with claim 2, further comprising a cold air control assembly disposed in the interior of the insulating plate and adapted to control an amount of cold air and an amount of moisture introduced in the kimchi container receiving box.

4. The refrigerator in accordance with claim 3, wherein the cold air control, assembly comprises:

a guide passage defined in the interior of the insulating plate and adapted to guide the cold air passing through the duct to the kimchi seasoning and storing chamber via the cold air supply port;

a valve member pivotally mounted in the insulating plate and adapted to selectively communicate the guide passage with the kimchi seasoning and storing chamber by its pivotal movement; and a control member adapted to pivot the valve member by its rotation and thus control the amount of cold air introduced in the kimchi container receiving box and a humidity in the kimchi seasoning and storing chamber.

5. The refrigerator in accordance with claim 4, wherein the valve member comprises:

a lever portion pivotally mounted to the insulating plate;

a valve plate portion formed at one end of the lever portion and adapted to open and close the guide passage according to a pivotal movement of the lever portion;

a guide port formed at one side portion of the valve plate portion and adapted to guide a flow of cold air to the kimchi seasoning and storing chamber when the guide passage is opened; and a rack formed at the other end of the lever portion and adapted to receive a driving force of the control member and rotate the lever portion in a normal direction and a reverse direction.

6. The refrigerator in accordance with claim 5, wherein the control member comprises:

a knob rotatably mounted to the insulating plate;

a pinion formed at a lower portion of the knob and adapted to engage with the rack formed at the valve member;

a wing formed at an upper portion of the knob and provided at one side portion thereof with a groove; and a knob cover supported on an upper surface of the wing such that it can slide rotatably irrespective of a rotation of the knob.

7. The refrigerator in accordance with claim 6, wherein the knob is provided at its upper surface with a grip portion which is integrally formed with the knob.

8. The refrigerator in accordance with claim 1, further comprising a kimchi container received in the kimchi container receiving box, the kimchi container being capable of sterilizing air-favorable fungi which become more active when the kimchi container is opened and closed.

9. The refrigerator in accordance with claim 8, wherein the kimchi container comprises:

a container body having an opened upper end and provided at one side portion thereof with a push switch and disposed adjacent to the opened upper end;

a lid pivotally mounted to the opened upper end of the container body and provided with a pushing end adapted to push the push switch;

an ultraviolet ray lamp mounted at the interior of the lid; and a drive circuit adapted to turn on the ultraviolet ray lamp according to a switching operation of the push switch.

10. The refrigerator in accordance with claim 9, wherein the drive circuit comprises:

a photo transistor connected to the push switch and adapted to be activated according to the switching ON/OFF of the push switch;

a microcomputer connected to the photo transistor and adapted to receive a signal generated from the photo transistor and output a signal for turning on the ultraviolet ray lamp; and a relay adapted to receive a signal outputted from the microcomputer and control the ultraviolet ray lamp by the received signal.

11. The refrigerator in accordance with claim 1, wherein the sensing means is dipped in the kimchi, for directly sensing the kimchi condition.

12. The refrigerator in accordance with claim 1, wherein the sensing means comprises at least, two sensors for sensing the kimchi condition.

13. The refrigerator in accordance with claim 1, further comprising a temperature sensor for sensing a peripheral temperature of the heaters under a condition that the outer case is installed in the refrigerator such that each wall thereof is in contact with each corresponding wall of the refrigerator, so that the heaters are prevented from being overheated.

* * * * *